US006389664B1

(12) United States Patent
Wood et al.

(10) Patent No.: US 6,389,664 B1
(45) Date of Patent: May 21, 2002

(54) PORTABLE BURIAL SYSTEM FOR CREMATION REMAINS

(76) Inventors: Beverley Ann Wood, 677-1755 Robson Street, Vancouver, BC (CA), V6G 3B7; Terrance Arthur Moody, 1543 College Ave., Livermore, CA (US) 94550

( * ) Notice: Subject to any disclaimer, the term of this patent is extended or adjusted under 35 U.S.C. 154(b) by 0 days.

(21) Appl. No.: 09/369,072

(22) Filed: Aug. 5, 1999

Related U.S. Application Data

(60) Provisional application No. 60/095,758, filed on Aug. 7, 1998.

(51) Int. Cl.[7] ..... A61G 17/00

(52) U.S. Cl. ..... 27/1; 40/124.5

(58) Field of Search ..... 27/1, 35; 40/124.5; 52/103, 104; 968/415; D10/45; 220/916, 359.1

(56) References Cited

U.S. PATENT DOCUMENTS

D113,887 S * 3/1939 West
3,561,982 A * 2/1971 Oeth ..... 220/916
3,581,452 A * 6/1971 Jalbert
3,726,052 A * 4/1973 Thompson
3,829,980 A * 8/1974 Iversen
3,898,718 A * 8/1975 Eubank
4,328,606 A * 5/1982 Nunes
5,729,921 A * 3/1988 Rojas
4,977,652 A * 12/1990 Graham
5,647,108 A 7/1997 Crook ..... 27/1
D390,323 S 2/1998 Parker et al. ..... D99/19
D398,132 S 9/1998 Thesken ..... D99/19
5,815,897 A * 10/1998 Longstreth
5,903,961 A 5/1999 Parker et al. ..... 27/1
5,966,868 A * 10/1999 Cox
D424,275 S * 5/2000 Parker et al.

* cited by examiner

*Primary Examiner*—Jack Lavinder
*Assistant Examiner*—William L. Miller
(74) *Attorney, Agent, or Firm*—Clifford F. Rey

(57) ABSTRACT

A portable burial system for interment of cremated remains of humans and/or pets that provides for complete underground burial in keeping with traditional burial practices is disclosed. The present burial system includes an ornamental marker structure, which is attached to an underlying supporting plate mounted on the ground surface. The supporting plate is also attached to an underlying burial container assembly and supports the container assembly with the interred cremated remains in a completely buried condition. The container assembly includes a tamperproof closure to provide a permanent seal and to prevent unauthorized access to the cremated remains. All of the burial system components are constructed of materials capable of resisting corrosion for an appreciable period of time under the intended conditions of use. The present burial system provides for unrestricted access and control over the deceased's remains when located on private property and for complete portability should the deceased's remains require relocation.

9 Claims, 3 Drawing Sheets

PORTABLE BURIAL SYSTEM FOR CREMATION REMAINS

CROSS-REFERENCE TO RELATED APPLICATION

This Application claims the benefit under 35 U.S.C. 119(e) of U.S. Provisional Application No. 60/095,758 filed Aug. 7, 1998 by Beverley A. Wood for Backyard Burial Kit.

BACKGROUND OF INVENTION

1. Field of Invention

This invention relates generally to funeral products and, more particularly, to a portable burial system for containing cremated human and/or pet remains.

In the funeral industry cremation has become an acceptable option for the interment of human remains. At the present time cremated human remains may be scattered at a designated location, stored in a container, or buried under applicable statutes. In recent years many Christian churches have changed their position on cremation from "negative" to "neutral" due to the growing reality of cost and space considerations for traditional cemetery burials. While this shift in the position of the Church has granted Christians permission to select the cremation option, many still choose the burial of cremated remains as a means of complying with the traditional Christian preference.

To date the problem with the burial of cremated human remains is threefold. First, it is very expensive because a burial plot must be purchased. Secondly, one does not generally have total control of the deceased's remains or burial site. Finally, one cannot easily relocate the deceased's remains at a future date.

Thus, the present invention has been developed to resolve these problems by providing a burial system for the interment of cremated human remains that is completely portable to permit convenient relocation. In addition, the present invention is cost efficient in that there are no significant expenses associated with the burial and/or relocation of the apparatus after the initial purchase and interment of the cremated remains.

2. Description of Related Prior Art

U.S. Pat. No. 5,903,961 to Daniel J. Parker, et al. discloses a combination lawn/garden ornament and cremation container comprising decorative structures adapted to be displayed outdoors on a lawn or in a garden of a deceased. Each disclosed embodiment discloses an openable compartment adapted to contain the cremated remains of a deceased. However, none of the disclosed embodiments in this patent provide for the complete burial of 100% of the cremated remains of a deceased in the manner of the present invention.

U.S. Pat. No. 5,647,108 to Robert S. Crook discloses a receptacle adapted to contain ashes such as human or animal ashes intended to be at least partially embedded in earth. The receptacle has a compartment for enclosing ashes, the compartment having an aperture for receiving the ashes. The receptacle also includes a closure means for sealing the aperture and support means capable of supporting the receptacle in a vertical position in the earth. This receptacle is also designed to be relocatable. However, this burial receptacle does not provide for complete underground burial of the deceased's cremated remains. Further, this burial receptacle requires an underground support apparatus to maintain the device in a vertical position in the earth.

U.S. Pat. No. D398,132 discloses an ornamental design for a combination lawn ornament and cremation container as shown and described.

U.S. Pat. No. D390,323 also discloses an ornamental design for a combination lawn ornament and cremation container as shown and described.

SUMMARY OF THE INVENTION

Accordingly, the present burial system comprises an ornamental burial marker in combination with a burial container for the interment of cremated human remains and/or pet remains, which provides for underground burial in keeping with traditional burial practices. The present burial system also provides for unrestricted access and control over the burial container when located on private property and for complete portability of the burial system should the deceased's remains require relocation.

The present burial system includes an ornamental marker structure, which is installed at ground level at the burial site and which is mechanically connected to the burial container. A plurality of interchangeable burial containers of different capacities are provided in the present system to accommodate different volumes of cremated remains such as for humans and/or pets. The selected burial container resides vertically below the ornamental marker structure and completely underground in its functional position. This construction conceals the burial container limiting knowledge of its existence to the discretion of the owner.

In view of the above, it is an object of the present invention to provide a burial system for the underground burial of cremation remains on private property allowing for convenience of visitation and full control over the burial site.

Another object of the present invention is to provide a burial system including a burial container in combination with an ornamental marker, which is completely portable in the event that relocation is required.

Another object of the present invention is to provide a burial system including a plurality of interchangeable burial containers of different capacities to accommodate different volumes of cremated remains.

Another object of the present invention is to provide a cost efficient burial system for cremation remains, which respects the tradition of full burial without incurring costs beyond the purchase price and securing the cremated remains within the burial container.

Another object of the present invention is to provide a burial memorial that appears to be merely decorative in nature thereby limiting knowledge of its functional purpose to the discretion of the owner.

BRIEF DESCRIPTION OF THE DRAWINGS

The novel features of the present invention are set forth in the appended claims. The invention itself, however, as well as other features and advantages thereof will be best understood by reference to the following detailed description of an illustrative embodiment when read in conjunction with the accompanying figures, wherein:

DETAILED DESCRIPTION OF THE PREFERRED EMBODIMENT

Figure 1:
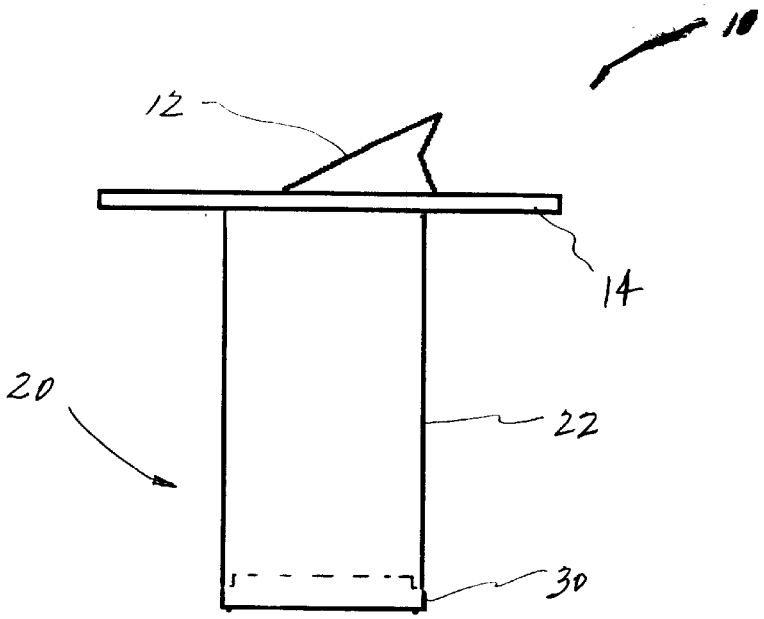
FIG. 1 is a side elevational view showing the present burial system.

With further reference to the drawings there is shown therein a portable burial system in accordance with the present invention, illustrated in FIG. 1 and indicated generally at 10. Burial system 10 includes an ornamental burial marker, indicated generally at 15, and a burial container assembly, indicated generally at 20, for interment of cremated human and/or pet remains.

In the preferred embodiment the burial marker 15 is comprised of an ornamental structure such as a sundial 12, which may be a functional instrument that indicates the time of day. The sundial 12 is to be constructed of any weather resistant material suitable for this purpose such as traditional bronze, stone, or other material.

The sundial 12 is preferably constructed to permit mechanical attachment to an underlying support plate 14 by means of attaching hardware formed of corrosion resistant material such as bronze, brass, or stainless steel. Thus, the sundial 12 may include a plurality of mounting apertures (not shown) drilled therein to accommodate the insertion of fasteners of different types through sundial 12 and into support plate 14.

Since such sundials as a separate instrument are well known to those skilled in the art, further detailed discussion of the same is not deemed necessary.

It will be understood that in the alternative, the burial marker 15 may consist of any ornamental structure such as lawn and garden ornaments and is not limited to the sundial 12. Further the marker 15 may include a memorial plaque (not shown) bearing an inscription identifying the deceased family member or pet at the discretion of the owner.

The support plate 14 is fabricated from weather resistant materials such as bronze, stone, or other material capable of resisting corrosion when disposed in direct contact with the ground surface. Support plate 14 functions primarily to locate the burial system 10 on the ground surface 35 and to provide adequate support for the container assembly 20, which is suspended directly underneath it in a buried condition. Thus, support plate 14 may be constructed in any geometric shape such as rectangular, circular, oval or other shape having sufficient surface area to support the weight of the burial container assembly 20.

In an alternative construction (not shown) a burial marker 15 such as sundial 12 and support plate 14 may be a unitary construction being integrally formed in bronze, stainless steel, engineering grade plastics or other suitable materials to simplify manufacturing.

Figure 2:
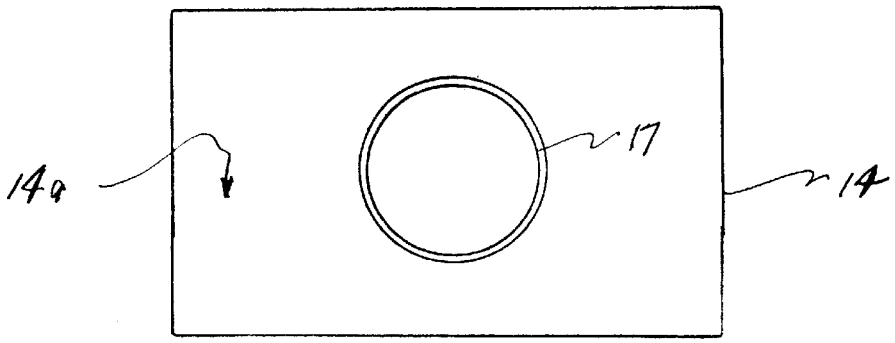
FIG. 2 is a bottom plan view of one embodiment of the support plate showing a circular groove formed therein.

In the preferred embodiment the support plate 14 includes a circular groove 17 formed in the underside or ground contacting surface 14a thereof as shown in FIG. 2. The circular groove 17 is dimensioned to receive and provide a seat for a mating end portion of the burial container assembly 20 as described hereinafter in further detail.

Preferably the burial container assembly 20 comprises an elongated, cylindrical canister 22 defining an interior compartment 24 of sufficient capacity to contain 100% of the cremated remains of the deceased. In accordance with the present invention, it will be understood that canister 22 is provided in different sizes ranging from 50 to 250 cubic inches or more to accommodate different volumes of cremated remains from human remains to those of small pet animals.

Canister 22 is constructed from anodized aluminum, stainless steel or other suitable tubular material of a predetermined diameter and length based upon the required capacity.

Figure 3:
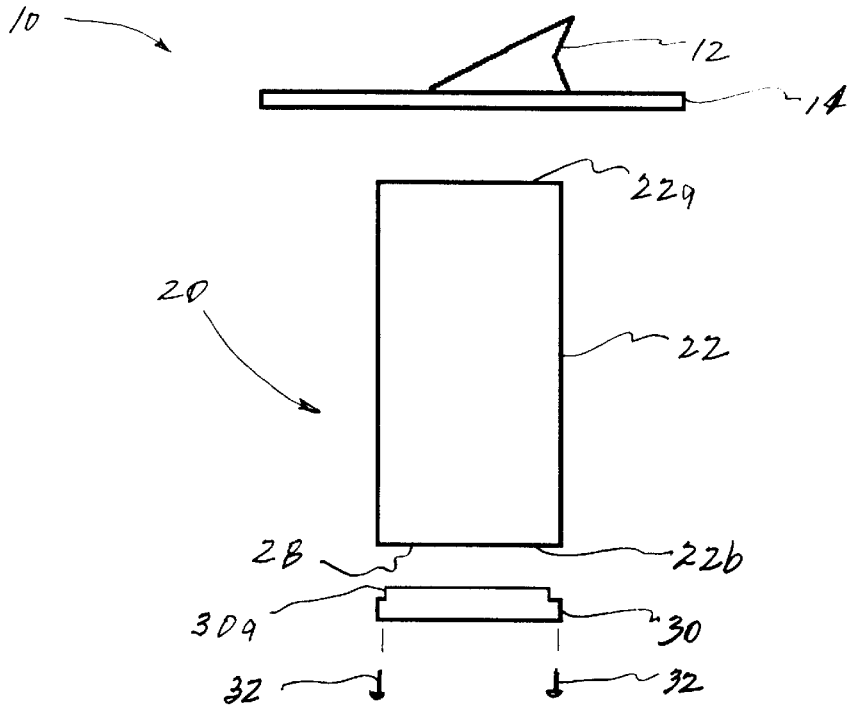
FIG. 3 is an exploded view of the burial system depicted in FIG. 1 showing the component parts thereof.

In the preferred construction, the tubular canister 22 is initially open at both ends thereof as seen in FIG. 3. A first end 22*a* of the precut canister 22 is slidingly inserted into the groove 17 and is retained therein by the use of an adhesive or sealant capable of providing a permanent joint and a waterproof seal. An adhesive of the type sold under the tradename Liquid Steel is suitable for this purpose.

Figure 4:
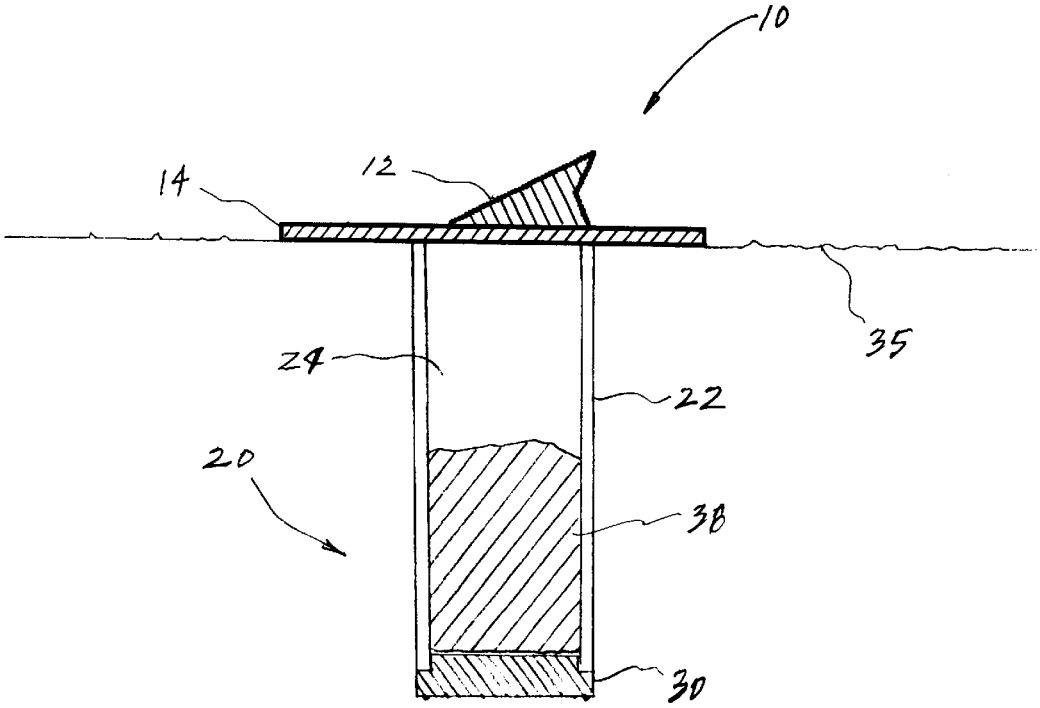
FIG. 4 is a cross-sectional view of the present burial system installed in its functional position.

An access opening 28 at the second end 22*b* of the canister 22 is closed with a sealing cap 30, which includes a boss 30*a* that is dimensioned to a close tolerance fit with the mating inside diameter of second end 22*b* of the canister. Suitable attaching hardware such as tamperproof screws 32 are used to secure the cap 30 to permanently seal the canister 22. In addition, a sealant (not shown) such as silicone caulk or other suitable sealant is applied to the mating surfaces of the cap 30 and canister to provide a waterproof seal after interment of the cremated remains 38 as seen in FIG. 4.

Since such tamperproof screws and sealant are well known to those skilled in the art, further detailed discussion of the same is not deemed necessary.

Figure 5:
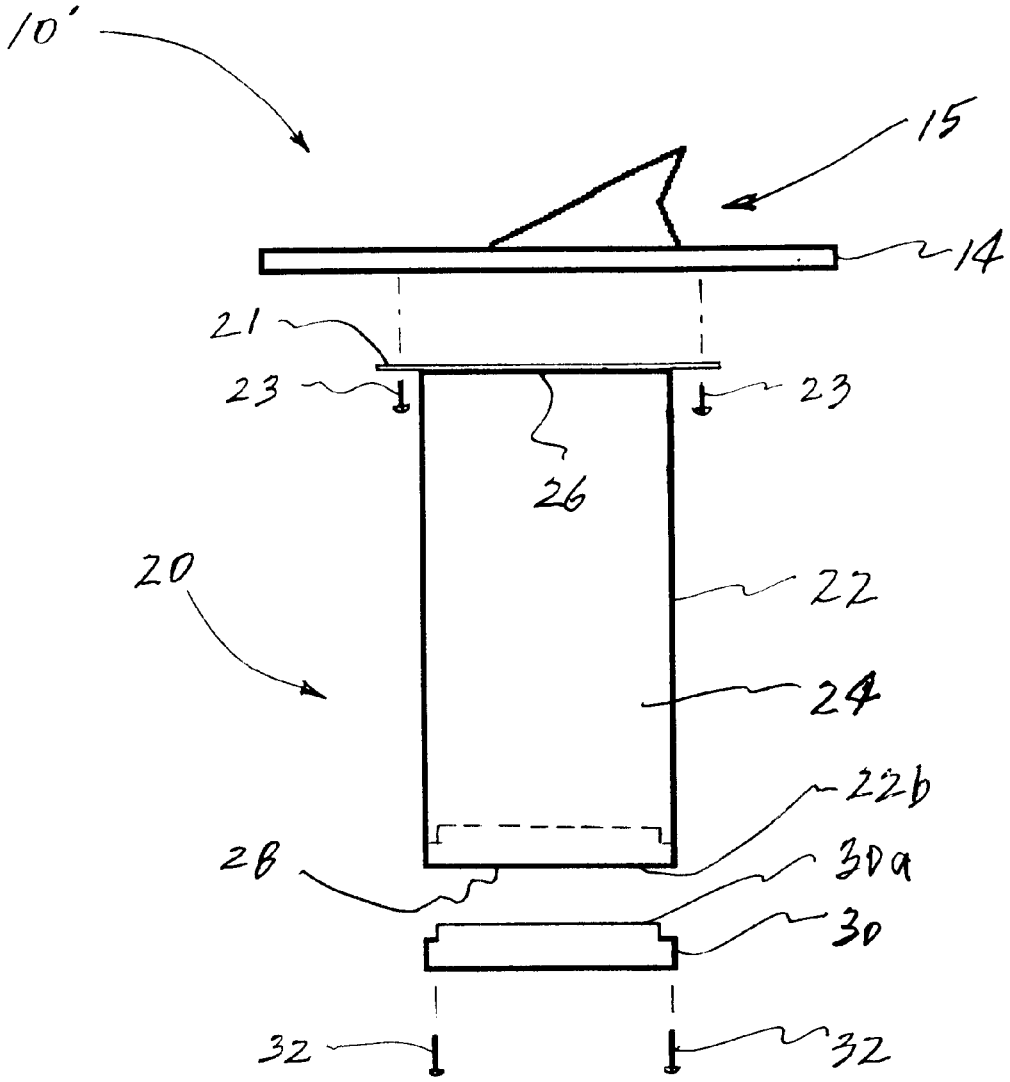
FIG. 5 is an exploded view of an alternative embodiment of the present burial system showing the component parts thereof.

In an alternative construction as shown in FIG. 5, canister 22 includes an integrally formed closed end 26 and an opening 28 at the second end 22*b,* which is also sealed by a mating cap 30. An inner surface of the canister 22 is machined to a predetermined dimension adjacent the opening 28 as shown to accommodate the installation of cap 30 therein.

In this alternative embodiment canister 22 includes an external, peripheral flange 21 disposed in juxtaposition to closed end 26 and attached thereto by weldment or other fastening means. Flange 21 includes a plurality of mounting apertures (not shown) drilled therein for attachment of the canister 22 to the underside of support plate 14 by fasteners such as machine bolts 23 as shown in FIG. 5.

In this embodiment the cap 30 is also precision machined to form a boss 30*a* thereon, which is dimensioned to a close tolerance fit with the mating inside diameter of canister 22. Suitable attaching hardware such as tamperproof screws 32 are again used to secure the cap 30 to prevent unauthorized access to the canister 22. In addition, a sealant such as silicone caulk is also applied to the mating surfaces of the cap 30 and the canister 22 to provide a waterproof seal after interment of the cremated remains 38.

In yet another alternative construction external threads (not shown) are machined onto boss 30*a* to provide mating engagement with internal threads (not shown) formed on an inner surface of canister 22 in a known manner to accomplish permanent sealing of the canister 22.

In all embodiments, canister 22, cap 30, machine bolts 23, and screws 32 are fabricated from materials such as stainless steel, bronze, engineering grade plastics, or a combination of such materials capable of resisting corrosion for an appreciable period of time under the intended conditions of use.

In practical use of the present burial system, the deceased's cremated remains 38 are disposed within the canister 22 at the crematorium and sealed therein by installation of the cap 30 using the techniques and attaching hardware as described hereinabove. The cremated remains 38 may be encased within a plastic bag or other similar liner if desired. At the option of the owner, the entire burial system 10 may be assembled at the crematorium or by a person of ordinary mechanical skills at the burial site.

After the burial site is excavated and prepared, the burial system 10 is disposed in the vertically upright position shown in FIG. 4 such that the sealed burial container assembly 20 is completely buried and resides under the ground surface as at 35. The support plate 14 resides on the ground surface to firmly locate the system 10 and to suspend and support the underlying burial container assembly 20 including the cremated remains 38 of the deceased family member or pet.

A significant advantage of the present burial system 10 is that it is completely portable and relatively simple to relocate in the event the owner sells the property, changes his/her residence, or the location is no longer practical for any reason. The owner has only to loosen the soil about the support plate 14 and the container assembly 20 to manually extract the burial system 10 and move it to the new location.

It will be appreciated that the present invention is a simple but effective advance over the prior art in that it provides a completely portable burial system for human and/or pet cremation remains, which respects the traditional practice of complete underground burial of the deceased.

Although not specifically illustrated in the drawings, it should be understood that additional equipment and structural components will be provided as necessary, and that all of the components described above are arranged and supported in an appropriate fashion to form a complete and operative system 10 incorporating features of the present invention.

It is also understood that variations may be made in the present invention without departing from the scope of the invention. For example, the system 10 may employ canisters of different capacities and/or configurations (not shown) for the interment of cremated pet remains in lieu of the canisters 22 utilized for cremated human remains. It is contemplated that any one of a variety of such modified and interchangeable canisters may be used in conjunction with the present system.

Moreover, although illustrative embodiments of the invention have been described, a certain latitude of modification, change, and substitution is intended in the foregoing disclosure, and in certain instances some features of the invention will be employed without a corresponding use of other features. Accordingly, it is appropriate that the appended claims be construed broadly and in a manner consistent with the scope of invention.

What is claimed is:

1. A portable burial system for the interment of the cremated remains of humans and pets, said burial system comprising:

an ornamental marker structure for identification of said cremated remains at a burial site;

a plurality of interchangeable container assemblies each including a canister having a first end and a second end, said canister defining an internal compartment of sufficient capacity to contain 100% of said cremated remains, said container assemblies having tamper resistant closure means including a sealable cap secured by tamperproof screws for permanently sealing an access opening formed in said second end of said canister; and supporting means being disposed intermediate said marker structure and said container assemblies in vertically stacked relation, said first end of said canister engaging a mating circular groove formed in a ground contacting surface of said supporting means to receive and permanently seal said first end of said canister, said supporting means being attached to said marker structure and said container assembly such that said container assembly can be completely buried in a vertical position when said supporting means is disposed on the ground surface.

2. The portable burial system of claim 1 wherein said canister is an elongated cylinder in configuration.

3. The portable burial system of claim 2 wherein said canister is constructed of stainless steel.

4. The portable burial system of claim 1 wherein said marker structure includes a sundial instrument.

5. The portable burial system of claim 4 wherein said sundial instrument and said supporting means are integrally formed as a unitary construction.

6. The portable burial system of claim 5 wherein said unitary construction is of a type selected from a group of materials consisting of bronze, stainless steel and engineering grade plastics.

7. The portable burial system of claim 1 wherein said supporting means includes a flattened sheet of material of a predetermined thickness having sufficient surface area to provide adequate support for said container assemblies in a buried condition thereof.

8. The portable burial system of claim 7 wherein said supporting means is constructed of material selected from a group consisting of stone, bronze, stainless steel, and engineering grade plastics.

9. The portable burial system of claim 1 wherein said capacity of said canisters is in the range of 50 to 250 cubic inches.

* * * * *